US009709937B2

(12) United States Patent
Izawa et al.

(10) Patent No.: US 9,709,937 B2
(45) Date of Patent: Jul. 18, 2017

(54) FIXING APPARATUS AND IMAGE FORMING APPARATUS

(71) Applicant: SAMSUNG ELECTRONICS CO., LTD., Suwon-si, Gyeonggi-do (KR)

(72) Inventors: Tatsunori Izawa, Yokohama (JP); Takayuki Horie, Yokohama (JP)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/154,221

(22) Filed: May 13, 2016

(65) Prior Publication Data

US 2016/0252857 A1 Sep. 1, 2016

Related U.S. Application Data

(63) Continuation of application No. PCT/KR2014/011678, filed on Dec. 2, 2014.

(30) Foreign Application Priority Data

Dec. 3, 2013 (JP) ..... 2013-250272
Dec. 4, 2013 (JP) ..... 2013-250906
Oct. 22, 2014 (JP) ..... 2014-215495

(51) Int. Cl.
*G03G 15/20* (2006.01)

(52) U.S. Cl.
CPC . *G03G 15/2053* (2013.01); *G03G 2215/0132* (2013.01); *G03G 2215/2025* (2013.01)

(58) Field of Classification Search
CPC ..... G03G 15/2053; G03G 2215/2025; G03G 2215/2016; G03G 2215/0132
USPC ..... 399/328, 329, 330, 333; 219/216, 619
See application file for complete search history.

(56) References Cited

U.S. PATENT DOCUMENTS 6,819,904 B2 11/2004 Terada et al.
9,213,281 B2 12/2015 Ishigaya et al.
2010/0260525 A1* 10/2010 Kinouchi ..... G03G 15/2064 399/329
2014/0010563 A1* 1/2014 Iwai ..... G03G 15/2053 399/67
2014/0314456 A1* 10/2014 Kikuchi ..... G03G 15/2053 399/329

FOREIGN PATENT DOCUMENTS

JP 2001-188430 7/2001
JP 2002-229360 8/2002
(Continued)

OTHER PUBLICATIONS

Machine translation of JP 2013-101375 (published on May 23, 2013) printed on Feb. 8, 2017.*
(Continued)

*Primary Examiner* — Sophia S Chen
(74) *Attorney, Agent, or Firm* — Staas & Halsey LLP

(57) ABSTRACT

The disclosed fixing apparatus includes: a magnetic field generation apparatus for generating a magnetic field; a fixing belt for emitting heat generated due to the magnetic field; and first and second thermally sensitive magnetic alloys arranged inside the fixing belt. A first Curie point of the first thermally sensitive magnetic alloy and a second Curie point of the second thermally sensitive magnetic alloy are different from each other.

19 Claims, 9 Drawing Sheets

(56) References Cited

FOREIGN PATENT DOCUMENTS

| | | |
|---|---|---|
| JP | 2006-267742 | 10/2006 |
| JP | 2010-204265 | 9/2010 |
| JP | 2011-197501 | 10/2011 |
| JP | 2013-41223 | 2/2013 |
| JP | 2013-57840 | 3/2013 |
| JP | 2013-101375 | 5/2013 |

OTHER PUBLICATIONS

International Search Report issued Feb. 27, 2015 in corresponding International Patent Application No. PCT/KR2014/011678.
International Search Report mailed Feb. 27, 2015, in corresponding International Application No. PCT/KR2014/011678.

* cited by examiner

FIXING APPARATUS AND IMAGE FORMING APPARATUS

CROSS-REFERENCE TO RELATED APPLICATIONS

This application is a continuation application filed under 35 U.S.C. §111(a), of International Application PCT/KR2014/011678, filed Dec. 2, 2014, and claims foreign priority benefit to Japanese Patent Application No. 2013-250272, filed Dec. 3, 2013, Japanese Patent Application No. 2013-250906, filed Dec. 4, 2013, and Japanese Patent Application No. 2014-215495, filed Oct. 22, 2014, the contents of which are incorporated herein by reference.

TECHNICAL FIELD

The inventive concept relates to a fixing apparatus for fixing a toner image by heating and pressing a medium passing between a fixing roll and a pressing roll, and an image forming apparatus.

BACKGROUND ART

A fixing apparatus fixes a toner image by applying heat and pressure to transported paper. For example, in a fixing apparatus using electromagnetic induction heating (IH), to control an excessive temperature rise, thermally sensitive magnetic alloys are arranged to face a magnetic field generation apparatus while interposing a fixing belt therebetween. When temperatures of the thermally sensitive magnetic alloys are higher than a Curie point, the thermally sensitive magnetic alloys lose their magnetism, and their magnetic fluxes are removed. Therefore, the excessive temperature rise in the fixing belt is restricted. Also, the thermally sensitive magnetic alloys have a heat storage function and a heat provision function, and when the fixing belt comes in contact with the thermally sensitive magnetic alloys, a decrease in a temperature of the fixing belt may be prevented when recording media continuously pass the fixing belt. Also, heat may be stably provided to the recording media.

(Patent document 1) JP 2008-152247A
(Patent document 2) JP 2001-188430A

DETAILED DESCRIPTION OF THE INVENTION

Technical Problem

One or more embodiments provide a fixing apparatus that may improve temperature rise performance, and an image forming apparatus.

One or more embodiments provide a fixing apparatus that may secure temperature uniformity of a rotor without enlargement of the fixing apparatus or a cost increase, and an image forming apparatus.

Technical Solution

According to an embodiment, a fixing apparatus includes: a magnetic field generator configured to generate a magnetic field; a rotor heated due to the magnetic field; and first and second thermally sensitive magnetic alloys arranged inside the rotor, wherein a first Curie point that is a Curie point of the first thermally sensitive magnetic alloy is different from a second Curie point that is a Curie point of the second thermally sensitive magnetic alloy.

The magnetic field generator may be located outside the rotor, and the first and second thermally sensitive magnetic alloys may be sequentially located on a side opposite to the magnetic field generator with respect to the rotor in a radial direction of the rotor.

The rotor, the first thermally sensitive magnetic alloy, and the second thermally sensitive magnetic alloy may sequentially overlap and contact each other.

The first Curie point may be higher than the second Curie point.

The second Curie point may be lower than a temperature of the rotor during a period when a general printing process is performed.

A thickness of the second thermally sensitive magnetic alloy may be greater than a thickness of the first thermally sensitive magnetic alloy.

The magnetic field generator may include a magnetic flux generator configured to generate a magnetic flux and a magnetic circuit formation unit configured to cover the magnetic flux generator and form a magnetic circuit for the magnetic flux, the magnetic flux generator may include a first magnetic flux generator and a second magnetic flux generator extending in parallel in an axial direction of the rotor, the magnetic circuit formation unit may include a plurality of first magnetic circuit units configured to cover the first magnetic flux generator and a plurality of second magnetic circuit units configured to cover the second magnetic flux generator, the plurality of first magnetic circuit units and the plurality of second magnetic circuit units may be alternately arranged in the axial direction, and when a length of the first magnetic flux generator and the second magnetic flux generator in the axial direction is d, a length of the plurality of first magnetic circuit units and the plurality of second magnetic circuit units in the axial direction is a, a distance between neighboring first magnetic circuit units and a distance between neighboring second magnetic circuit units are b, following conditions $$b/d \leq 0.2$$

$$0.5 \leq b/a \leq 2$$

may be satisfied.

The plurality of first magnetic circuit units and the plurality of second magnetic circuit units may have the same shape.

The distance between the neighboring first magnetic circuit units may decrease towards an end portion of the axial direction from a central portion of the axial direction, and the distance between the neighboring second magnetic circuit units may decrease towards the end portion of the axial direction from the central portion of the axial direction.

The distance between the neighboring first magnetic circuit units may decrease at a rate of 5% or less towards the end portion of the axial direction from the central portion of the axial direction, and the distance between the neighboring second magnetic circuit units may decrease at a rate of 5% or less towards the end portion of the axial direction from the central portion of the axial direction.

According to an embodiment, a fixing apparatus includes: a rotor heated due to a magnetic flux; a magnetic flux generator arranged outside the rotor and configured to generate a magnetic flux; and a magnetic circuit formation unit configured to cover the magnetic flux generator and form a magnetic circuit for the magnetic flux. The magnetic flux generator includes a first magnetic flux generator and a second magnetic flux generator which are arranged in parallel and extend in an axial direction of the rotor, the magnetic circuit formation unit includes a plurality of first magnetic circuit units configured to cover the first magnetic flux generator and a plurality of second magnetic circuit units configured to cover the second magnetic flux generator, the plurality of first magnetic circuit units and the plurality of second magnetic circuit units are alternately arranged in the axial direction, when a length of the first magnetic flux generator and the second magnetic flux generator in the axial direction is d, a length of the plurality of first magnetic circuit units and the plurality of second magnetic circuit units in the axial direction is a, and distances between neighboring first magnetic circuit units and between neighboring second magnetic circuit units are b, following conditions $$b/d \leq 0.2$$

$$0.5 \leq b/a \leq 2$$

are satisfied.

The plurality of first magnetic circuit units and the plurality of second magnetic circuit units may have the same shape.

The distance between the neighboring first magnetic circuit units may decrease towards an end portion of the axial direction from a central portion of the axial direction, and the distance between the neighboring second magnetic circuit units may decrease towards the end portion of the axial direction from the central portion of the axial direction.

The distance between the neighboring first magnetic circuit units may decrease at a rate of 5% or less towards the end portion of the axial direction from the central portion of the axial direction, and the distance between the neighboring second magnetic circuit units may decrease at a rate of 5% or less towards the end portion of the axial direction from the central portion of the axial direction.

According to an embodiment, an image forming apparatus includes the aforementioned fixing apparatus.

Advantageous Effects of the Invention

According to an embodiment, temperature rise performance may be improved.

According to an embodiment, temperature uniformity of a rotor may be secured.

MODE OF THE INVENTION

Hereinafter, the inventive concept will be described in detail by explaining embodiments of the inventive concept with reference to the attached drawings.

First Embodiment

Figure 1:
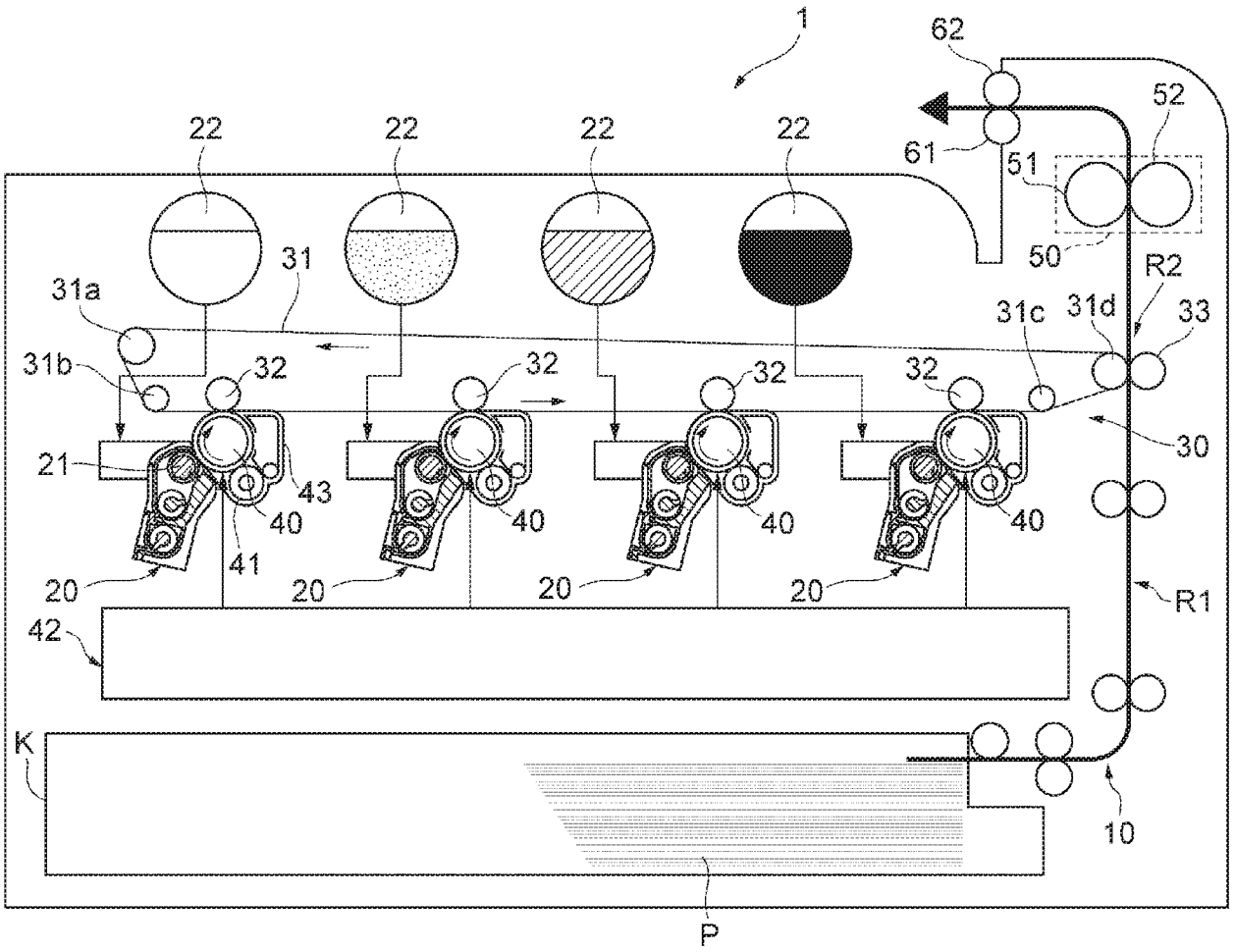
FIG. 1 is a schematic diagram of an image forming apparatus including a fixing apparatus, according to a first embodiment.

An image forming apparatus 1 according to a first embodiment produces a color image by using various colors such as magenta, yellow, cyan, and black. As shown in FIG. 1, the image forming apparatus 1 includes a recording medium transport unit 10 for transporting paper P, a developing device 20 for developing an electrostatic latent image, a transfer unit 30 for secondarily transferring a toner image on the paper P, a photoreceptor drum 40 that is an electrostatic latent image carrier for forming an image on an outer circumference surface of the photoreceptor drum 40, and a fixing apparatus 50 for fixing the toner image on the paper P.

The recording medium transport unit 10 houses paper P, which is a recording medium on which an image is formed, and transports the paper P to a transport path R1. The paper P is stacked and then housed in a cassette K. The recording medium transport unit 10 transports the paper P to a secondary transfer region R2 via a transport path R1 at a timing when the toner image, which is to be transferred to the paper P, reaches the secondary transfer region R2.

Four developing devices 20 may be included to correspond to respective colors. Each developing device 20 includes a developing roller 21 that supplies a toner to the photoreceptor drum 40. After the toner and the carrier are mixed and then sufficiently charged in the developing device 20, a developer that is generated by a mixture of the toner and the carrier is carried by the developing roller 21. When the developer is moved to an area facing the photoreceptor drum 40 due to rotation of the developing roller 21, the toner that is included in the developer carried by the developing roller 21 is moved to an electrostatic latent image that is formed on a circumferential surface of the photoreceptor drum 40 so that the electrostatic latent image is developed.

The transfer unit 30 moves the toner image, which is formed by the developing device 20, to the secondary transfer region R2 in order to secondarily transfer the toner image on the paper P. The transfer unit 30 includes a transfer belt 31, suspension rollers 31*a*, 31*b*, 31*c*, and 31*d* that suspend the transfer belt 31, a preliminary transfer roller 32, and a secondary transfer roller 33. The transfer belt 31 is arranged between the photoreceptor drum 40 and the preliminary transfer roller 32 and between the suspension roller 31*d* and the secondary transfer roller 33.

The transfer belt 31 is a seamless belt that is circulated by operation of the suspension rollers 31*a*, 31*b*, 31*c*, and 31*d*. The preliminary transfer roller 32 presses the photoreceptor drum 40 from an inner circumference of the transfer belt 31. The secondary transfer roller 33 presses the suspension roller 31*d* from an outer circumference of the transfer belt 31.

There are four photoreceptor drums 40 corresponding to colors. The photoreceptor drums 40 are arranged along a direction in which the transfer belt 31 moves. Along a circumference of each photoreceptor drum 40, the developing device 20, a charging roller 41, an exposure unit 42, and a cleaning unit 43 are arranged.

The charging roller 41 uniformly charges a surface of the photoreceptor drum 40 to a predetermined electric potential. The exposure unit 42 exposes the surface of the photoreceptor drum 40, which is charged by the charging roller 41, to light according to image information to be formed on the paper P. Accordingly, an electric potential of a portion of the surface of the photoreceptor drum 40, which is exposed to the light by the exposure unit 42, changes, and thus an electrostatic latent image is formed. The developing devices 20 produce toner images by developing electrostatic latent images formed on the photoreceptor drums 40 by using toners provided by toner tanks 22 respectively corresponding to the developing devices 20. In the respective toner tanks 22, magenta, yellow, cyan, and black toners and carriers are filled. The cleaning unit 43 collects toners remaining in the photoreceptor drums 40 after a preliminary transferring process.

The fixing apparatus 50 fixes the toner image, which is secondarily transferred to the paper P from the transfer belt 31, on the paper P. The fixing apparatus 50 includes a fixing belt 51 that heats the paper P and is seamless and a pressing roll 52 that presses the fixing belt 51. The fixing belt 51 and the pressing roll 52 are cylindrically shaped. A nip portion N (refer to FIG. 2) that is a contact area is formed between the fixing belt 51 and the pressing roll 52, and the toner image is fused and then fixed to the paper P by passing the paper P through the nip portion N in, for example, a transport direction Dl.

The fixing belt 51 functions as a rotor having a heating layer. The fixing belt 51 may include, for example, a heating layer formed on an inner circumferential surface of the fixing belt 51 and a surface release layer formed on an outer circumferential surface. The heating layer of the fixing belt 51 may be, for example, a metallic layer having a thickness of about 10 to 100 μm and including a nickel-copper (Ni—Cu) layer, and the surface release layer of the fixing belt 51 may include, for example, tetrafluoroethylene perfluoroalkylvinyl copolymers (PFA) having a thickness of about 10 to 100 μm.

Also, in the image forming apparatus 1, discharge rollers 61 and 62 for discharging the paper P, on which the toner image is fixed by the fixing apparatus 50, to the outside are installed.

Operations of the image forming apparatus 1 will be described. When image signals of an image to be printed are input to the image forming apparatus 1, a controller (not shown) of the image forming apparatus 1 uniformly charges surfaces of the photoreceptor drums 40 to a predetermined electric potential by using the charging roller 41 and controls the exposure unit 42 to irradiate laser beams onto the surfaces of the photoreceptor drums 40 according to the input image signals, thereby forming electrostatic latent images. The developing devices 20 form toner images by developing the electrostatic latent images. The formed toner images are preliminarily transferred to the transfer belt 31 from the photoreceptor drums 40 in an area where the photoreceptor drums 40 face the transfer belt 31. On the transfer belt 31, the toner images transferred from the photoreceptor drums 40 are sequentially stacked, and a single stacked toner image is formed. The stacked toner image is secondarily transferred to the paper P, which is transported from the recording medium transport unit 10, in a secondary transfer region where the suspension roller 31*d* faces the secondary transfer roller 33.

The paper P to which the stacked toner image is secondarily transferred is transported to the fixing apparatus 50. The fixing apparatus 50 passes the paper P by heating and pressing the paper P between the fixing belt 51 and the pressing roll 52 and then fuses and fixes the stacked toner image to the paper P. Then, the paper P is discharged to the outside of the image forming apparatus 1 by the discharge rollers 61 and 62.

The fixing apparatus 50 will be described below.

Figure 2:
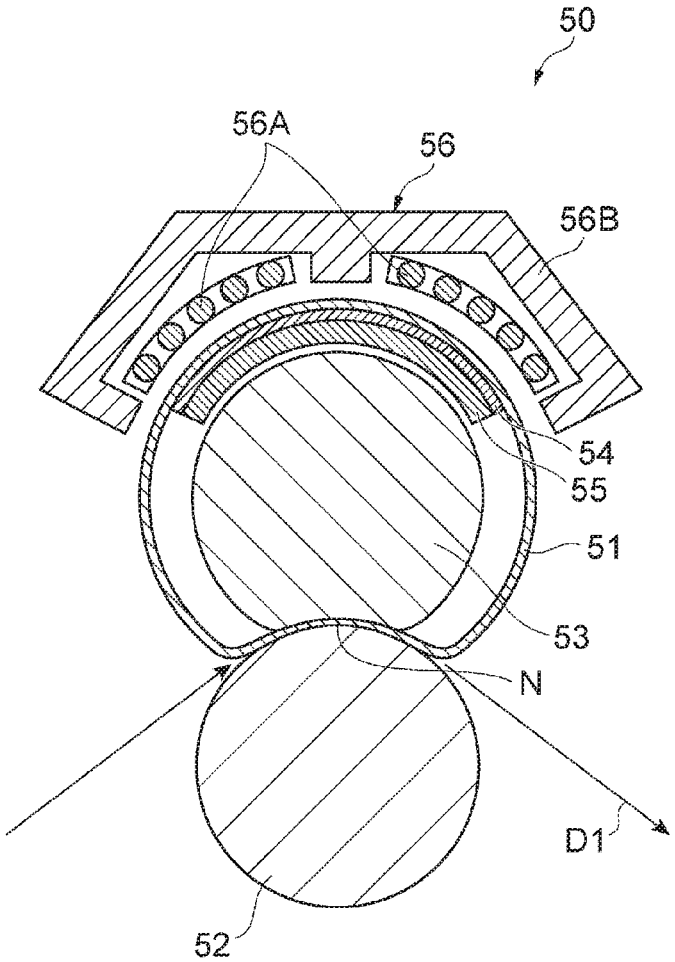
FIG. 2 is a cross-sectional view of the fixing apparatus of FIG. 1.

As shown in FIG. 2, the fixing apparatus 50 includes the fixing belt 51, the pressing roll 52, a fixing roll 53 arranged inside the fixing belt 51, a magnetic field generation apparatus (a magnetic field generator) 56 for heating the fixing belt 51, and a first thermally sensitive magnetic alloy 54 and a second thermally sensitive magnetic alloy 55 arranged inside the fixing belt 51. From an outer side of the fixing apparatus 50, the magnetic field generation apparatus 56, the fixing belt 51, the first thermally sensitive magnetic alloy 54, and the second thermally sensitive magnetic alloy 55 are sequentially arranged. The fixing belt 51 is a heated rotor that is heated by a magnetic field generated by the magnetic field generation apparatus 56. The fixing belt 51 is wound around the fixing roll 53. Contact pressure is applied between the fixing roll 53 and the fixing belt 51, and the nip portion N is formed due to the contact pressure. Also, since rotation of the fixing roll 53 is transmitted to the fixing belt 51 so that the fixing belt 51 rotates.

The magnetic field generation apparatus 56 is located outside the fixing belt 51, and the first and second thermally sensitive magnetic alloys 54 and 55 are sequentially located, with respect to the fixing belt 51, on a side opposite to the magnetic field generation apparatus 56 in a radial direction of the fixing belt 51.

The magnetic field generation apparatus 56 generates a magnetic field on an upper portion (an outer portion) of the fixing belt 51. The magnetic field generation apparatus 56 includes coil portions 56A for heating the fixing belt 51 and a magnetic field shield portion 56B for covering the coil portions 56A. A pair of coil units 56A is installed on the upper portion of the fixing belt 51 and covers an upper side portion in a rotation direction of the fixing belt 51. The magnetic field shield portion 56B is installed to shield a magnetic field generated in the coil unit 56A. An output frequency of the magnetic field generation apparatus 56 may be, for example, from about 20 kHz to about 100 kHz.

The first thermally sensitive magnetic alloy 54 is arranged inside the fixing belt 51. The first thermally sensitive magnetic alloy 54 is arranged to face the magnetic field generation apparatus 56 with the fixing belts 51 therebetween. The first thermally sensitive magnetic alloy 54 contacts the fixing belt 51 at a location where the magnetic field is generated by the magnetic field generation apparatus 56. The first thermally sensitive magnetic alloy 54 is installed at an upper inner portion of the fixing belt 51 and contacts an upper side portion of an inner circumference of the fixing belt 51. A cross section of the first thermally sensitive magnetic alloy 54 is arc-shaped. An outer circumferential surface of the first thermally sensitive magnetic alloy 54 contacts an inner circumferential surface of the fixing belt 51. The first thermally sensitive magnetic alloy 54 includes a material of which magnetism changes at a Curie temperature. The first thermally sensitive magnetic alloy 54 becomes a ferromagnetic substance at a temperature lower than a first Curie point T1 that is a Curie temperature of the first thermally sensitive magnetic alloy 54 and becomes a non-magnetic material at a temperature higher than the first Curie point T1. A thickness of the first thermally sensitive magnetic alloy 54 may be, for example, 0.3 mm.

The second thermally sensitive magnetic alloy 55 is arranged on an inner side of the first thermally sensitive magnetic alloy 54. A cross section of the second thermally sensitive magnetic alloy 55 is arc-shaped. An outer circumferential surface of the second thermally sensitive magnetic alloy 55 contacts an inner circumferential surface of the first thermally sensitive magnetic alloy 54. Similar to the first thermally sensitive magnetic alloy 54, the second thermally sensitive magnetic alloy 55 includes a material whose magnetism changes at a Curie temperature. The second thermally sensitive magnetic alloy 55 becomes a ferromagnetic substance at a temperature lower than a second Curie point T2 that is a Curie temperature of the second thermally sensitive magnetic alloy 55 and becomes a non-magnetic material at a temperature higher than the second Curie point T2. A thickness of the second thermally sensitive magnetic alloy 55 is greater than a thickness of the first thermally sensitive magnetic alloy 54 and may be, for example, 0.6 mm.

In the fixing apparatus 50, a diameter of the ring-shaped fixing belt 51 is greater than a diameter of the fixing roll 53. For example, the diameter of the fixing belt 51 may be 40 mm, and the diameter of the fixing roll 53 may be 35 mm. Also, the diameter of the pressing roll 52 may be smaller than the diameter of the fixing roll 53 and may be, for example, 30 mm.

The first Curie point T1 of the first thermally sensitive magnetic alloy 54 is higher than the second Curie point T2 of the second thermally sensitive magnetic alloy 55. For example, the first Curie point T1 ranges from about 180° C. to about 240° C., and the second Curie point T2 ranges from about 40° C. to about 170° C. Also, a surface temperature of the fixing belt 51 at which the fixing belt 51 is generally controlled during a fixing operation, that is, a temperature T of the fixing belt 51 during a general printing process, is lower than the first Curie point T1, but higher than the second Curie point T2. The temperature T may range, for example, from about 140° C. to about 200° C.

As described above, in the fixing apparatus 50 and the image forming apparatus 1 including the fixing apparatus 50, since the fixing belt 51, the first thermally sensitive magnetic alloy 54, and the second thermally sensitive magnetic alloy 55 themselves emit heat due to the magnetic field generation apparatus 56, temperatures thereof may quickly rise, and thus, temperature rise performance may be improved at a point in time when printing starts.

Also, the first Curie point T1 of the first thermally sensitive magnetic alloy 54 is different from the second Curie point T2 of the second thermally sensitive magnetic alloy 55. Therefore, self-heating of the first thermally sensitive magnetic alloy 54 and the second thermally sensitive magnetic alloy 55 are accelerated to a certain temperature based on magnetization and non-magnetization of the first thermally sensitive magnetic alloy 54 and the second thermally sensitive magnetic alloy 55 according to the first Curie point T1 and the second Curie point T2, and thus temperature rise efficiency may be improved. Also, since the first thermally sensitive magnetic alloy 54 and the second thermally sensitive magnetic alloy 55 function as non-magnetic materials and magnetic fluxes thereof are removed after reaching the certain temperature, an excessive temperature rise may be controlled. Accordingly, heat may be effectively provided to the fixing belt 51, and accuracy of temperature control may increase.

Also, since the fixing belt 51, the first thermally sensitive magnetic alloy 54, and the second thermally sensitive magnetic alloy 55 contact each other, heat is quickly transmitted between the fixing belt 51, the first thermally sensitive magnetic alloy 54, and the second thermally sensitive magnetic alloy 55. Therefore, the temperature of the fixing belt 51 may quickly rise.

Also, the second Curie point T2 of the second thermally sensitive magnetic alloy 55 is lower than the first Curie point T1 of the first thermally sensitive magnetic alloy 54. Accordingly, at the second Curie point T2, the second thermally sensitive magnetic alloy 55 may function as a non-magnetic material, and at the first Curie point T1, the first thermally sensitive magnetic alloy 54 may also function as a non-magnetic material. Therefore, since the first thermally sensitive magnetic alloy 54 and the second thermally sensitive magnetic alloy 55 themselves do not emit heat at the first Curie point T1, an excessive temperature rise may be controlled.

Also, the second Curie point T2 of the second thermally sensitive magnetic alloy 55 that contacts the first thermally sensitive magnetic alloy 54 is lower than the temperature T of the fixing belt 51 during the general printing process. Since the second Curie point T2 is set to be lower than the temperature T of the fixing belt 51 during the general printing process, the second thermally sensitive magnetic alloy 55 becomes a non-magnetic material and thus does not emit heat during the general printing process. Therefore, since the heat emission by the second thermally sensitive magnetic alloy 55 is suppressed, power consumption is also suppressed.

Figure 3:
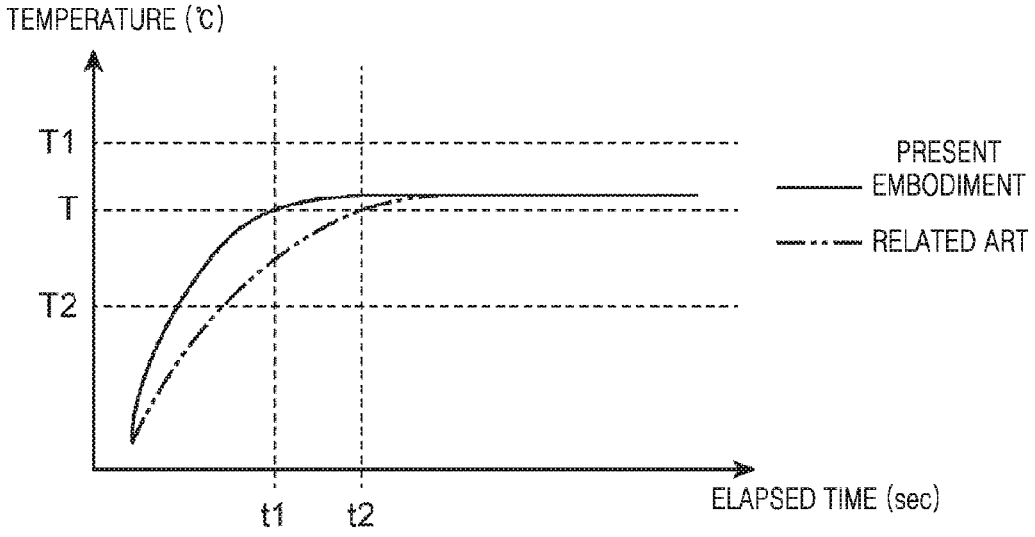
FIG. 3 is a graph showing a relationship between a temperature of a fixing apparatus and an elapsed time from a point in time when power is applied.

As shown in FIG. 3, in the present embodiment, the first Curie point T1 of the first thermally sensitive magnetic alloy 54 is higher than the temperature T, and the second Curie point T2 of the second thermally sensitive magnetic alloy 55 is lower than the temperature T, during the general printing process. Therefore, at a temperature lower than the second Curie point T2, the first thermally sensitive magnetic alloy 54 and the second thermally sensitive magnetic alloy 55 function as magnetic materials such that a temperature may more effectively rise than in the related art.

Also, at a temperature higher than the second Curie point T2, the second thermally sensitive magnetic alloy 55 becomes a non-magnetic material. However, since the first thermally sensitive magnetic alloy 54 functioning as a magnetic material contacts the fixing belt 51, heat may be effectively transmitted between the first thermally sensitive magnetic alloy 54 and the fixing belt 51. Therefore, a temperature rise efficiency is greater than in the related art. In the present embodiment, a time t1 that is taken to reach the temperature T during the general printing process may be lower than a time t2 in the related art. For example, the time t1 is 10 seconds, and the time t2 is 12 seconds.

Also, the thickness of the thermally sensitive sensing magnetic alloy 55 is greater than the thickness of the first thermally sensitive magnetic alloy 54. Therefore, at a temperature close to the first Curie point T1, the second thermally sensitive magnetic alloy 55 that is a non-magnetic material effectively suppresses the temperature rise such that an excessive temperature rise may be prevented.

In the first embodiment, a case where the rotor having the heating layer is the fixing belt 51 has been described, but the rotor may not be a fixing belt. That is, the rotor may be, for example, a cylindrical hard roller, instead of the fixing belt 51.

Also, in the first embodiment, the first Curie point T1 is higher than the temperature T, and the second Curie point T2 is lower than the temperature T during the conventional printing process. However, a relationship between the first Curie point T1, the second Curie point T2, and the temperature T is not limited thereto, and the first Curie point T1 is different from the second Curie point T2 during the general printing process.

Also, in the first embodiment, although the diameter of the pressing roll 52 is smaller than the diameter of the fixing roll 53, the diameter of the pressing roll may be the same as or greater than the diameter of the fixing roll. As described, the diameters of the pressing roll and the fixing roll may be appropriately changed.

Also, in the first embodiment, an output frequency of the magnetic field generation apparatus 56 is between about 20 kHz and about 100 kHz, but may be appropriately changed. Furthermore, a structure of the magnetic field generation apparatus may be appropriately changed.

Second Embodiment

An image forming apparatus 101 according to a second embodiment will be described.

(The Entire Structure of the Image Forming Apparatus)

Figure 4:
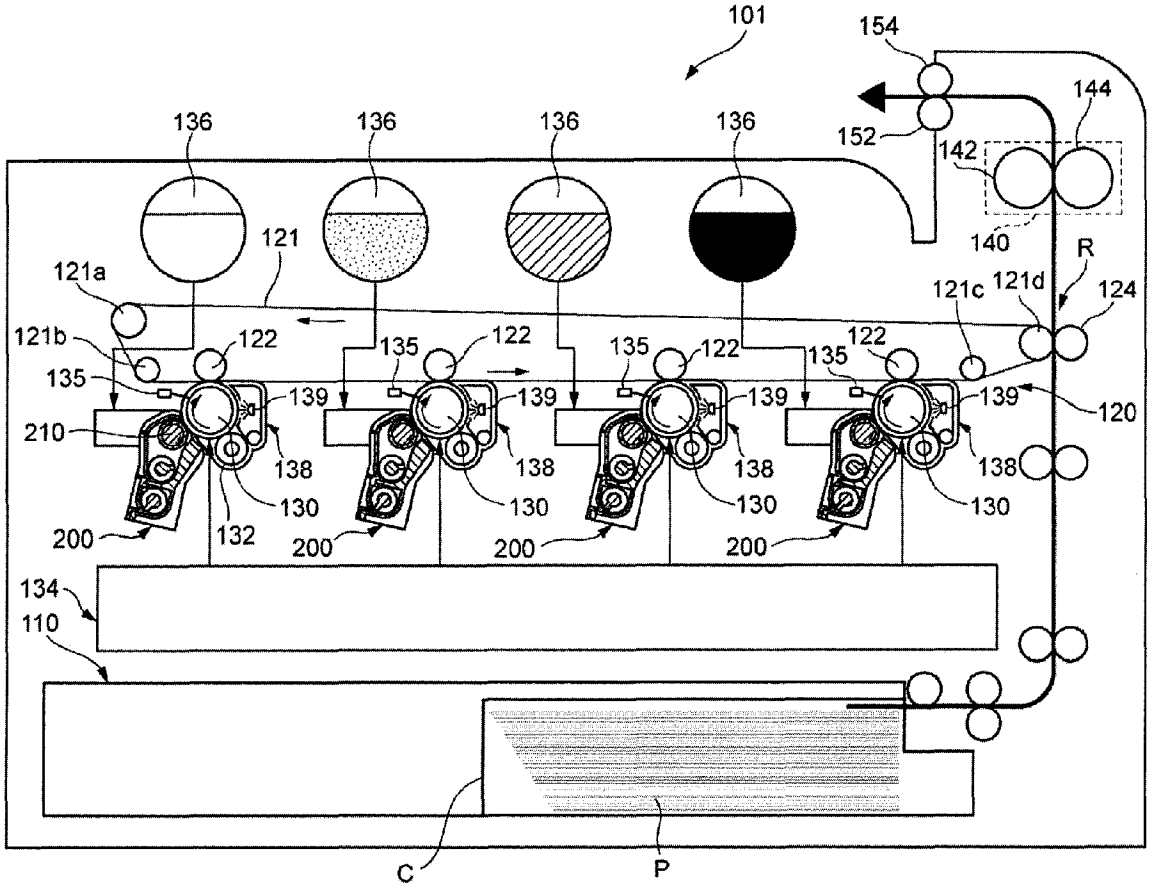
FIG. 4 is a schematic diagram of an image forming apparatus according to a second embodiment.

As shown in FIG. 4, the image forming apparatus 101 uses an electro-photography method and includes a transport unit 110, a transfer unit 120, a photoreceptor drum 130, four developing units 200, and a fixing apparatus 140.

The transport unit 110 houses paper P, which is a recording medium on which an image is finally formed, and transports the paper P along a recording medium transport path. The paper P is stacked in cassette C and housed therein. The transport unit 110 transports the paper P to the secondary transfer region R at a timing when a toner image that is transferred to the paper P reaches the secondary transfer region R.

The transfer unit 120 transports the toner image, which is formed by four developing units 200, to the secondary transfer region R in order to secondarily transfer the toner image to the paper P. The transfer unit 120 includes a transfer belt 121, suspension rollers 121*a*, 121*b*, 121*c*, and 121*d* that suspend the transfer belt 121, a preliminary transfer roller 122, and a secondary transfer roller 124. The transfer belt 121 is disposed between the photoreceptor drum 130 and the preliminary transfer roller 122 and between the suspension roller 121*d* and the secondary transfer roller 124.

The transfer belt 121 is an endless belt that is circulated by the suspension rollers 121*a*, 121*b*, 121*c*, and 121*d*. The preliminary transfer roller 122 is installed to press the photoreceptor drum 130 from an inner circumference of the transfer belt 121. The secondary transfer roller 124 is installed to press the suspension roller 121*d* from an outer circumference of the transfer belt 121. Also, the transfer unit 120 may further include a belt cleaning device for removing a toner attached to the transfer belt 121, etc.

The photoreceptor drum 130 is a drum-shaped electrostatic latent image carrier, and an image is formed on a circumferential surface of the photoreceptor drum 130. For example, the photoreceptor drum 130 may include an organic photo conductor (OPC). The image forming apparatus 101 according to the present embodiment may produce a color image, and four photoreceptor drums 130 respectively corresponding to colors, that is, magenta, yellow, cyan, and black, are installed in a direction in which the transfer belt 121 moves. Each photoreceptor drum 130 is driven by a drum motor 135. As shown in FIG. 4, around a circumference of each photoreceptor drum 130, a charging roller 132, an exposure unit 134, the drum motor 135, a cleaning unit 138, and the developing units 200 are respectively installed.

The charging roller 132 uniformly charges a surface of the photoreceptor drum 130 to a predetermined electric potential by a charge voltage applied to the charging roller 132. The charging roller 132 is close to or contacts the photoreceptor drum 130 and evenly charges the surface of the photoreceptor drum 130 based on a micrometric gap discharge. The exposure unit 134 exposes the surface of the photoreceptor drum 130, which is charged by the charging roller 132, to light according to images to be formed on the paper P. Accordingly, an electric potential of a portion of the surface of the photoreceptor drum 130, which is exposed by the exposure unit 134, changes, and thus an electrostatic latent image is formed. When a developing voltage is applied to the developing roller 210, four developing units 200 attach toners, which are provided from toner tanks 136 installed to respectively correspond to the developing units 200, to electrostatic latent images written to the photoreceptor drum 130, thereby forming a toner image. Magenta, yellow, cyan, and black toners are filled in the toner tanks 136, respectively.

The cleaning unit 138 collects toners that remain on the photoreceptor drums 130 after the toner image formed on the photoreceptor drums 130 is preliminary transferred to the transfer belt 121. The cleaning unit 138 includes, for example, cleaning blades, and may remove the toners remaining on the photoreceptor drums 130 by contacting the cleaning blades with circumferential surfaces of the photoreceptor drums 130. Also, the cleaning unit 138 may include a static electricity removing lamp 139 that is located on the circumference of the photoreceptor drum 130 and controls an electric potential of the surface of the photoreceptor drum 130. Being turned on, the static electricity removing lamp 139 removes static electricity from the surface of the photoreceptor drum 130. The static electricity removing lamp 139 operates during an operation of forming (printing) an image and thus sets the electric potential of the surface of the photoreceptor drum 130 to a desired value. Also, the static electricity removing lamp 139 operates in a non-printing period, for example, after a transfer operation, etc., and thus residual charges of the photoreceptor drum 130 have a voltage less than an optical attenuation voltage after an operation of printing an image, and the electric potential of the surface of the photoreceptor drum 130 may be reset. Instability of a charging potential which is caused by the residual charges may be solved, and generation of ghosts in an image may be restricted by the static electricity removing lamp 139. Also, the non-printing period includes periods before and after a printing operation as well as periods between pages when a multi-page printing is performed.

The fixing apparatus 140 includes the pressing rotor 142 and a heating rotor 144, and attaches and fixes the toner image, which is secondarily transferred from the transfer belt 121 to the paper P, to the paper P. Detailed descriptions of the fixing apparatus 140 will be provided below.

Also, in the image forming apparatus 101, discharge rollers 152 and 154 for discharging the paper P, on which the toner image is fixed by the fixing apparatus 140, to the outside are installed.

Operations of the image forming apparatus 101 will now be described. When image signals of an image to be printed are input to the image forming apparatus 101, a controller of the image forming apparatus 101 uniformly charges surfaces of the photoreceptor drums 130 to a predetermined electric potential by using the charging roller 132 and forms an electrostatic latent image via a laser beam irradiated onto the surfaces of the photoreceptor drums 130 by the exposure unit 134 based on the input image signals.

The developing unit 200 mixes a toner with a carrier and sufficiently charges the toner and the carrier, and then a two-component type developer, in which the toner and the carrier are mixed, is carried by the developing roller 210. When the developer is moved to an area facing the photoreceptor drums 130 due to rotation of the developing roller 210, the toner included in the developer carried by the developing roller 210 is moved to the electrostatic latent image formed on the circumferential surface of the photoreceptor drum 130, and thus the electrostatic latent image is developed. A toner image that is formed by developing the electrostatic latent image is preliminarily transferred from the photoreceptor drum 130 to the transfer belt 121 in an area where the photoreceptor drum 130 faces the transfer belt 121. On the transfer belt 121, toner images formed on four photoreceptor drums 130 are sequentially stacked, and a stacked toner image is formed. The stacked toner image is secondarily transferred to the paper P that is transported from the transport unit 110 in the secondary transfer region R where the suspension roller 121*d* faces the secondary transfer roller 124.

The paper P on which the stacked toner image is secondarily transferred is transported to the fixing apparatus 140. The fixing apparatus 140 passes the paper P by heating and pressing the paper P between the heating rotor 144 and the pressing rotor 142 and then fuses and fixes the stacked toner image on the paper P. Then, the paper P is discharged to the outside of the image forming apparatus 101 by the discharge rollers 152 and 154. When the image forming apparatus 101 includes a belt cleaning device, a toner, which remains on the transfer belt 121 after the stacked toner image is secondarily transferred to the paper P, may be removed by the belt cleaning device.

(A Structure of the Fixing Apparatus)

Figure 5:
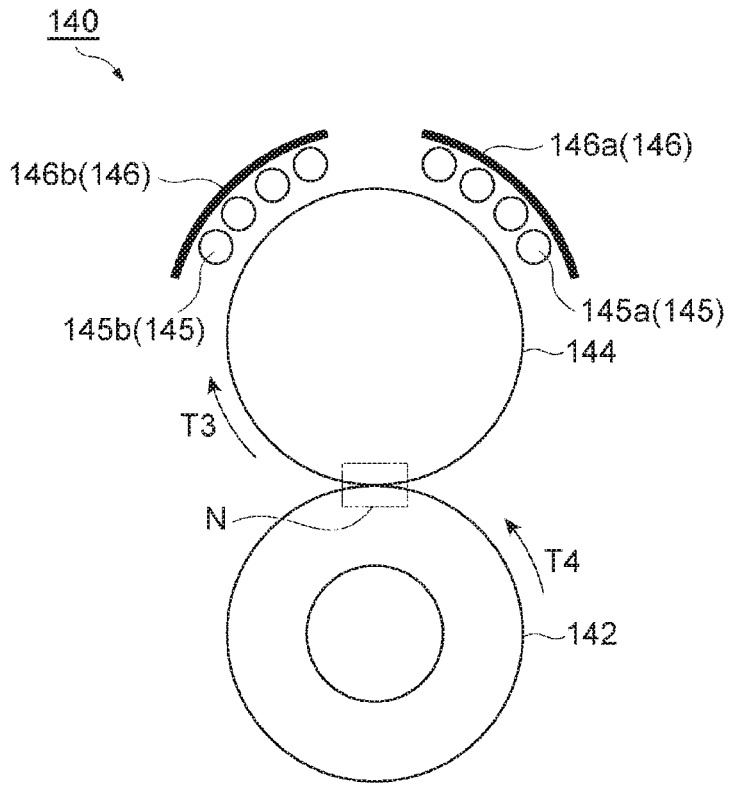
FIG. 5 is a schematic diagram of a fixing apparatus of FIG. 4.

Then, the detailed structure of the fixing apparatus 140 will be described with reference to FIGS. 5 and 6. As shown in FIG. 5, the fixing apparatus 140 includes the pressing rotor 142 that is cylindrically shaped and rotates around a circumference of a rotation axis, the heating rotor 144, excitation coils 145 arranged outside the heating rotor 144, and magnetic cores 146 covering the excitation coils 145. A magnetic field generator may include the excitation coils 145 generating a magnetic flux and the excitation coils 145 forming a magnetic circuit for the magnetic flux.

The pressing rotor 142 presses the heating rotor 144 and may include silicon rubber having a hardness of JISA65. A surface of the pressing rotor 142 may be coated with fluororesin, etc. in order to increase wear resistance and releasability. Also, the pressing rotor 142 may include a sponge-type foaming body. Also, the pressing rotor 142 may include materials having a low thermal conductivity in order to prevent thermal diffusion. A length of an axial direction of the pressing rotor 142 may range, for example, from about 210 mm to about 370 mm, and an external diameter thereof may range, for example, from about 20 mm to about 60 mm.

The heating rotor 144 includes a heating layer and may also include a metal conductor that is a magnetic material such as iron (Fe), nickel (Ni), chromium (Cr), or copper (Cu). A surface of the heating rotor 144 may be coated with fluororesin, etc. in order to increase the wear resistance and releasability. A length of an axial direction of the heating rotor 144 may range, for example, from about 210 mm to about 370 mm, and an external diameter thereof may range, for example, from about 20 mm to about 200 mm. The heating rotor 144 emits heat due to a magnetic flux generated by the excitation coils 145. That is, the magnetic flux generated by the excitation coils 145 is induced to the surface of the heating rotor 144 by the magnetic core 146 and generates an eddy current. Thus, Joule's heat is generated on the surface the heating rotor 144, and the heating rotor 144 emits heat. A surface temperature of the heating rotor 144 is from about 140° C. to about 200° C. during a fixing process.

The heating rotor 144 rotates in a direction (a rotation direction T3) by a driving motor, and the pressing rotor 142 accordingly rotates in a direction, that is, a rotation direction T4, opposite to the rotation direction T3. The pressing rotor 142 and the heating rotor 144 fuse and fix the toner image on the paper P (refer to FIG. 4) by passing the paper P through a fixing nip portion N that is an area where the pressing rotor 142 and the heating rotor 144 contact each other.

The excitation coil 145 is a magnetic flux generator that is arranged outside the heating rotor 144 and generates a magnetic flux by electromagnetic induction as a high-frequency current is applied thereto. An output frequency of the excitation coils 145 ranges from about 20 kHz to about 100 kHz. Also, the excitation coils 145 are arranged on a side opposite to the pressing rotor 142 with respect to the heating rotor 144 and may be arranged to cover half of an external diameter of the heating rotor 144. The excitation coils 145 do not contact the heating rotor 144, but are close thereto, and a distance between the excitation coils 145 and the heating rotor 144 may be, for example, from about 1 mm to about 10 mm.

Figure 6:
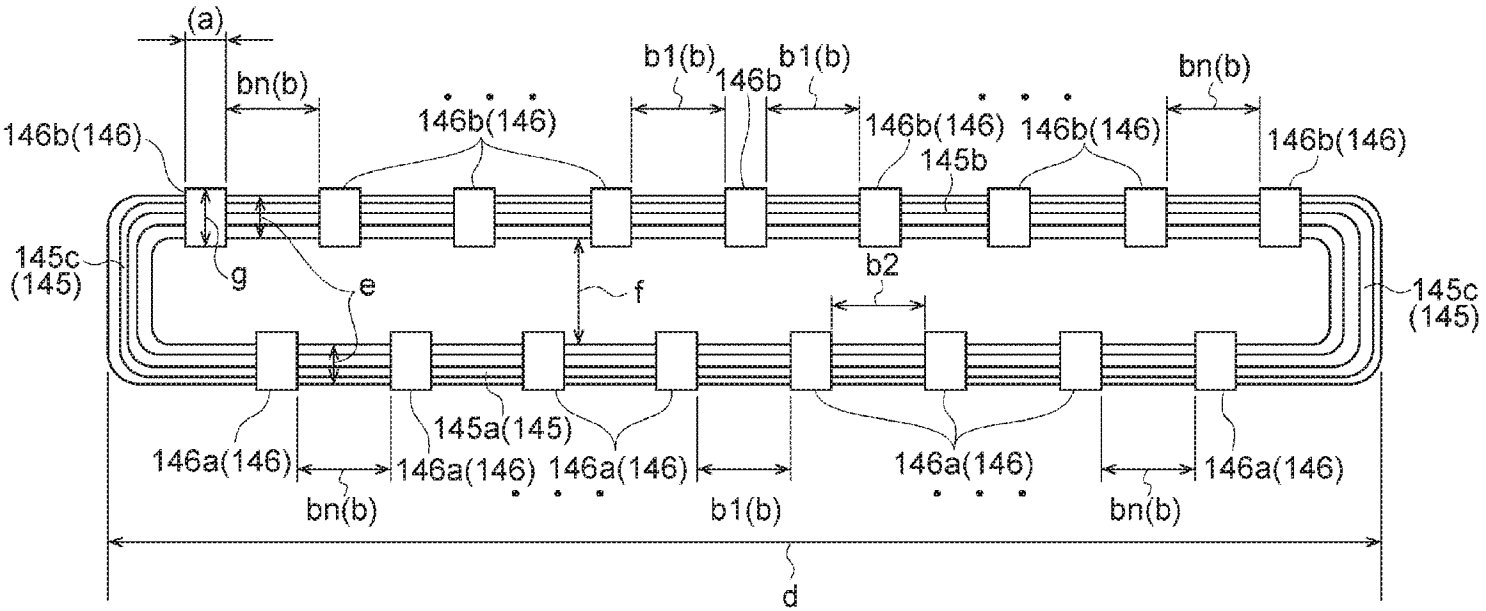
FIG. 6 is a diagram for explaining about an excitation coil and a magnetic core of the fixing apparatus of FIG. 4.

As shown in FIG. 6, the excitation coils 145 are race-track type coils and include a bundle of conducting wires in which copper wires with insulated surfaces are bundled up. The excitation coil 145 includes a forward straight portion 145*a* that is a forward path of an applied high frequency, a backward straight portion 145*b* that is a backward path, and an arc portion 145*c* that connects the forward straight portion 145*a* and the backward straight portion 145*b*.

The forward straight portion 145*a* (a first magnetic flux generator) and the backward straight portion 145*b* (a second magnetic flux generator) extend in parallel in an axial direction of the heating rotor 144 (hereinafter, referred to as the 'axial direction'). A length d (a total width of the excitation coils 145) of the forward straight portion 145*a* and the backward straight portion 145*b* in the axial direction is almost the same as a length of the heating rotor 144 in the axial direction and may be, for example, 220 mm to 440 mm. Also, a length e of the forward straight portion 145*a* and the backward straight portion 145*b* in a circumferential direction of the heating rotor 144 (hereinafter, referred to as the 'circumferential direction') may be, for example, 10 mm to 30 mm. Also, a distance f between the forward straight portion 145*a* and the backward straight portion 145*b* may be, for example, 10 mm to 30 mm. The arc portion 145*c* extends in the circumferential direction of the heating rotor 144.

The magnetic core 146 is a magnetic circuit formator that is arranged to cover the excitation coils 145 and forms a magnetic circuit for a magnetic flux generated by the excitation coils 145. The magnetic core 146 receives the magnetic flux generated by the excitation coils 145 without any magnetic flux leakage and then induces the magnetic flux to the heating rotor 144. The magnetic core 146 is arranged on a side opposite to the heating rotor 144 with respect to the excitation coils 145. The magnetic core 146 does not contact the excitation coils 145, but is close thereto. A distance between the magnetic core 146 and the excitation coils 145 may be, for example, about 1 mm to about 10 mm.

Also, the magnetic core 146 may include a magnetic material, for example, ferrite, which has high magnetic permeability and low loss. The magnetic core 146 includes a plurality of forward magnetic circuit units 146*a* (first magnetic circuit units) that cover the forward straight portion 145*a* and a plurality of backward magnetic circuit units 146*b* (second magnetic circuit units) that cover the backward straight portion 145*b*. The forward magnetic circuit units 146*a* and the backward magnetic circuit units 146*b* may have the same shape. The forward magnetic circuit units 146*a* cover the forward straight portion 145*a* only, and the backward magnetic circuit units 146*b* cover the backward straight portion 145*b* only, among the excitation coils 145.

The forward magnetic circuit units 146*a* may be arranged at regular intervals in the axial direction of the heating rotor 144. The backward magnetic circuit units 146*b* may be arranged at regular intervals in the axial direction of the heating rotor 144. A length a of the forward magnetic circuit unit 146*a* and the backward magnetic circuit unit 146*b* in the axial direction may be, for example, about 8 mm to about 12 mm. Also, a length g of the forward magnetic circuit unit 146*a* and the backward magnetic circuit unit 146*b* in the circumferential direction is greater than the length e of the forward straight portion 145*a* and the backward straight portion 145*b* in the circumferential direction and may be, for example, about 20 mm to about 40 mm. In addition, the length g of the forward magnetic circuit unit 146*a* and the backward magnetic circuit unit 146*b* in the circumferential direction may be the same as or smaller than the length e of the forward straight portion 145*a* and the backward straight portion 145*b* in the circumferential direction. That is, the statement that the forward magnetic circuit units 146*a* cover the forward straight portion 145*a* indicates that the forward magnetic circuit units 146*a* may cover the entire forward straight portion 145*a* in the circumferential direction or may cover part of the forward straight portion 145*a* in the circumferential direction.

A distance b between neighboring forward magnetic circuit units 146*a* and a distance b between neighboring backward magnetic circuit units 146*b* may be, for example, about 10 mm to about 16 mm. Also, the distance b may gradually decrease towards an end portion of the axial direction from a central portion of thereof. In particular, the distance b may decrease at a rate of 5% or less towards the end portion of the axial direction from the central portion of thereof. For example, when a distance b1 between the neighboring forward magnetic circuit units 146*a* at the central portion of the axial direction is about 15 mm, a distance b2 between the neighboring forward magnetic circuit units 146*a* at the end portion of the axial direction decreases at a rate of 5% or less with respect to the distance b1 and thus becomes about 14.3 mm (numbers rounded off to the first decimal place). Likewise, the distance b decreases at a rate of 5% or less towards the end portion of the axial direction.

Also, the forward magnetic circuit units 146*a* and the backward magnetic circuit units 146*b* may be alternately arranged in the axial direction. That is, one backward magnetic circuit unit 146*b* has to be arranged between the neighboring forward magnetic circuit units 146*a* in the axial direction, and one forward magnetic circuit unit 146*a* has to be arranged between the neighboring backward magnetic circuit units 146*b*. In addition, an area where the forward magnetic circuit units 146*a* are arranged in the axial direction and an area where the backward magnetic circuit units 146*b* are arranged in the axial direction may partially overlap each other or may not overlap each other. However, in terms of temperature uniformity, it is advantageous to arrange the areas not to overlap each other.

The length d of the forward straight portion 145*a* and the backward straight portion 145*b* in the axial direction, the length a of the forward magnetic circuit units 146*a* and the backward magnetic circuit units 146*b* in the axial direction, and the distances b between the neighboring forward magnetic circuit units 146*a* and between the neighboring backward magnetic circuit units 146*b* satisfy the following conditions (1) and (2).

$$b/d \leq 0.2 \quad (1)$$

$$0.5 \leq b/a \leq 2 \quad (2)$$

Next, an effect of the fixing apparatus 140 according to the present embodiment will be described by comparing the fixing apparatus 140 with fixing apparatuses 240A and 240B according to comparative examples shown in FIG. 7, with reference to FIGS. 8 to 10. Also, FIG. 7 does not show a heating rotor.

Figure 7:
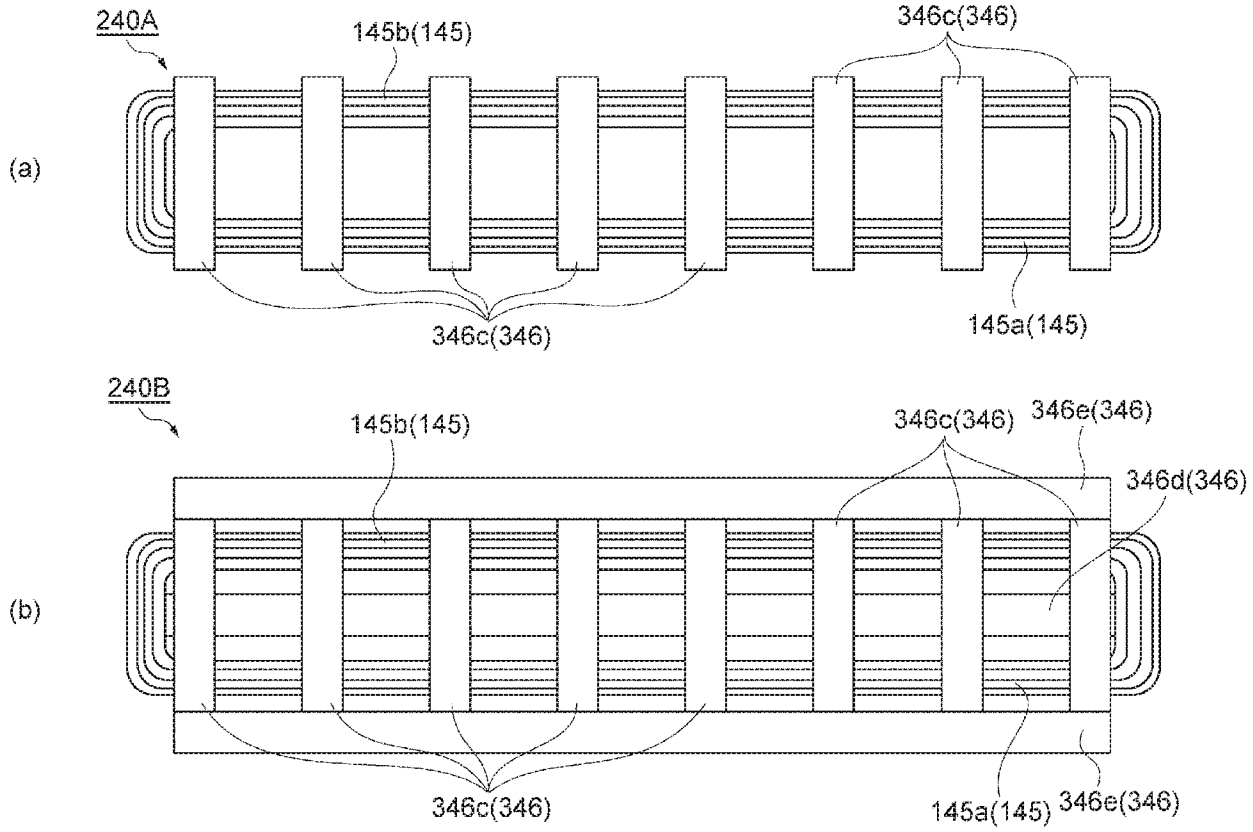
FIG. 7 is a diagram for explaining about an excitation coil and a magnetic core of a fixing apparatus according to a comparative example.
Figure 8:
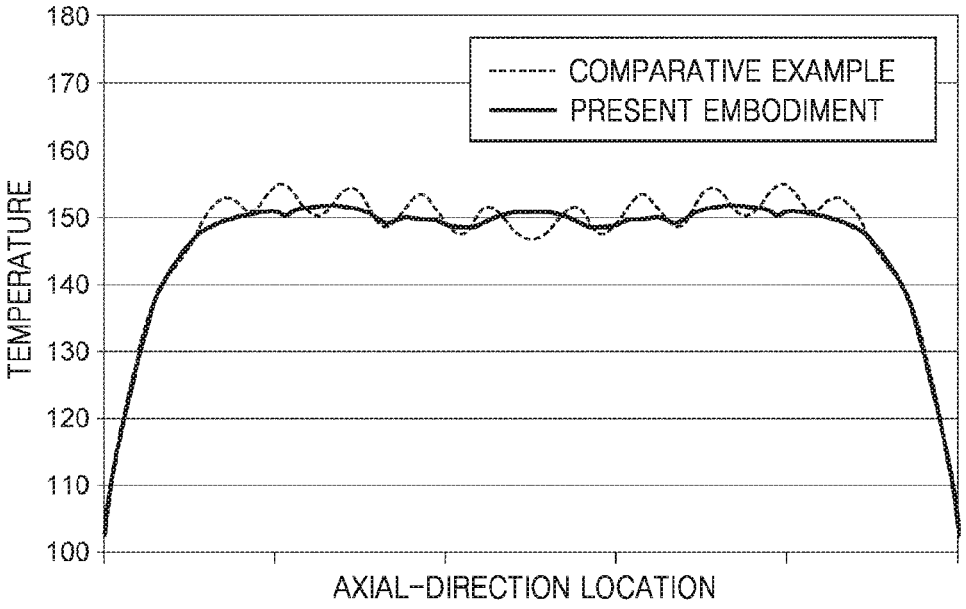
FIG. 8 is a graph showing a comparison result with respect to temperature uniformity of the fixing apparatus of FIG. 4 and the fixing apparatus of the comparative example.

In the fixing apparatus 240A according to a comparative example 1 of FIG. 7(*a*), the excitation coils 145 are arranged outside a heating rotor as in the fixing apparatus 140 according to the present embodiment. The excitation coil 145 includes the forward straight portion 145*a* and the backward straight portion 145*b* extending in parallel in the axial direction. However, the fixing apparatus 240A is different from the fixing apparatus 140 in that magnetic cores 346 of the fixing apparatus 240A cover the excitation coils 145.

That is, the magnetic core 346 includes a transverse magnetic circuit unit 346*c* that crosses and covers the forward straight portion 145*a* and the backward straight portion 145*b*. In this case, an area where the excitation coils 145 are arranged in the axial direction may be any one of an area where both the forward straight portion 145*a* and the backward straight portion 145*b* are covered by the transverse magnetic circuit unit 346*c* and an area where both the forward straight portion 145*a* and the backward straight portion 145*b* are not covered by the transverse magnetic circuit unit 346*c* at all. To this end, an area where a magnetic flux is easily applied to a heating rotor is clearly distinguished from an area where a magnetic flux is not easily applied to a heating rotor so that it is difficult to uniformize a temperature of the heating rotor in the axial direction.

In order to uniformize the temperature of the heating rotor in the axial direction, as shown in FIG. 7(*b*), the fixing apparatus 240B may further include a center core 346*d* and a pair of side cores 346*e*. The center core 346*d* is arranged between the forward straight portion 145*a* and the backward straight portion 145*b* and extends in the axial direction in parallel with the forward straight portion 145*a* and the backward straight portion 145*b*, and the side cores 346*e* are arranged side portions of the transverse magnetic circuit units 346*c* in the circumferential direction and extend in the axial direction in parallel with the center core 346*d*. In this case, a magnetic flux concentrated on the transverse magnetic circuit units 346*c* is evenly distributed by the center core 346*d* and the side cores 346*e* in the axial direction, and thus a temperature of the heating rotor in the axial direction is uniformized. However, due to the center core 346*d* and the side cores 346*e*, the fixing apparatus 240B increases in size, and manufacturing costs also increase.

In the fixing apparatus 140 according to the present embodiment, the forward magnetic circuit units 146*a* covering the forward straight portion 145*a* and the backward magnetic circuit units 146*b* covering the backward straight portion 145*b* are alternately arranged in the axial direction of the heating rotor 144. Thus, the area, where the forward magnetic circuit units 146*a* covering the forward straight portion 145*a* are arranged, and the area, where the backward magnetic circuit units 146*b* covering the backward straight portion 145*b* are arranged, are distributed in the axial direction of the heating rotor 144, and the magnetic flux may be uniformly applied to the heating rotor 144.

Also, as the length d of the forward straight portion 145*a* and the backward straight portion 145*b* in the axial direction, the length a of the forward magnetic circuit units 146*a* and the backward magnetic circuit units 146*b* in the axial direction, and distances b between the neighboring forward magnetic circuit units 146*a* and between the neighboring backward magnetic circuit units 146*b* are appropriately adjusted, a magnetic flux is appropriately provided to an area of the heating rotor 144 corresponding an area (an area between magnetic circuit units) where the forward magnetic circuit units 146*a* and the backward magnetic circuit units 146*b* are not arranged. Thus, temperature uniformity in the axial direction may be secured. In detail, as shown in FIG. 8, in the fixing apparatus according to the comparative example 1, a temperature of a heating rotor greatly differs in an area where the transverse magnetic circuit unit 346*c* is installed and an area where the transverse magnetic circuit unit 346*c* is not installed, and there is a deviation in the temperature according to locations in the axial direction. However, in the fixing apparatus 140 according to the present embodiment, regardless of the locations in the axial direction, the temperature of the heating rotor may be almost uniform. As described above, in the fixing apparatus 140 according to the present embodiment, a temperature may be uniform without any center core or side core that is another type of magnetic circuit unit and is used to uniformly maintain a magnetic flux, that is, without enlargement of a fixing apparatus or an increase in costs.

A maximal temperature deviation in which a toner is stably fixed to paper is about 15° C. Thus, the temperature deviation of about 15° C. is a target temperature deviation. FIG. 9 shows values of the temperature deviation that are measured by changing the distances b (a core distance) between the neighboring forward magnetic circuit units 146*a* and the neighboring backward magnetic circuit units 146*b* with respect to the distance d (a coil width) between the forward straight portion 145*a* and the backward straight portion 145*b* in the axial direction. Also, FIG. 9 shows measurement results of the temperature deviation in fixing apparatuses S3 and S4 of which coil widths d are different from each other.

Figure 9:
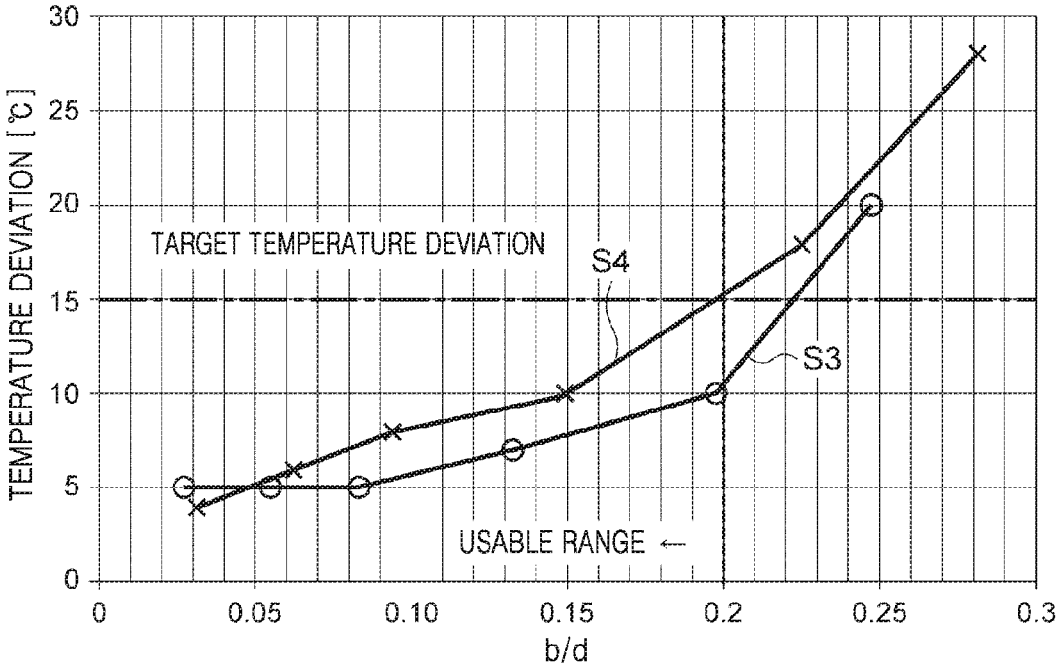
FIG. 9 is a graph showing a relationship between a core gap, a coil width, and a temperature deviation.

As shown in FIG. 9, when a value produced by dividing the distances b (the core distance) between the neighboring forward magnetic circuit units 146*a* and the neighboring backward magnetic circuit units 146*b* by the core widths d, that is, a value of b/d, is equal to or greater than 0.2, a magnetic flux may not be sufficiently collected such that a condition regarding the target temperature deviation is not satisfied. Therefore, by satisfying the following condition, $$b/d \leq 0.2 \quad (1)$$

the temperature uniformity in the axial direction may be secured.

Figure 10:
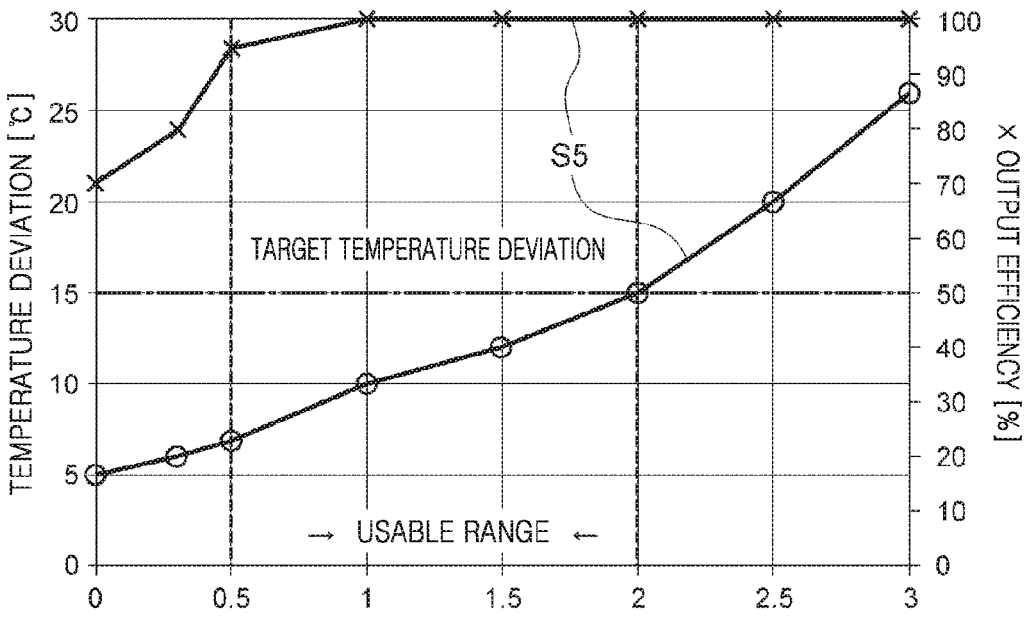
FIG. 10 is a graph showing a relationship between a core gap, a core width, and a temperature deviation.

Also, FIG. 10 shows values of a temperature deviation of a fixing apparatus S5 that are measured by changing the distances b between the cores with respect to the length a (a core width) of the forward magnetic circuit units 146*a* and the backward magnetic circuit units 146*b* in the axial direction. As shown in FIG. 10, when a value that is produced by dividing the core distance b by the core width a, that is, a value of b/a, is equal to or greater than 2, a magnetic flux may not be sufficiently collected such that a condition regarding the target temperature deviation is not satisfied. Also, when a value of b/a is less than or equal to 0.5, impedance is considerably large such that an output efficiency degrades. Therefore, by satisfying the following condition, $$0.5 \leq b/a \leq 2 \quad (2)$$

the temperature uniformity in the axial direction is secured, and the degradation of the output efficiency is prevented. Therefore, functions of a fixing apparatus may be stably provided.

In addition, as the forward magnetic circuit units 146*a* and the backward magnetic circuit units 146*b* have the same length a in the axial direction and the same shape, an influence of a magnetic flux on the heating rotor 144 due to the forward magnetic circuit units 146*a* and the backward magnetic circuit units 146*b* may be more uniform. Thus, the temperature uniformity of the heating rotor 144 in the axial direction is improved. Also, since the forward magnetic circuit units 146*a* and the backward magnetic circuit units 146*b* have the same shape, manufacturing costs are decreased, and assemblability of the forward magnetic circuit units 146*a* and the backward magnetic circuit units 146*b* may be improved.

Also, in general, a temperature of a heating rotor tends to decrease towards an end portion of an axial direction of the heating rotor. Since the distances b between the neighboring forward magnetic circuit units 146*a* and between the backward magnetic circuit units 146*b* decrease towards the end portion of the axial direction from the central portion of the axial direction, the end portion of the heating rotor 144 in the axial direction may be greatly affected by the magnetic flux applied by the forward magnetic circuit units 146*a* and the backward magnetic circuit units 146*b*. Thus, the temperature uniformity of the heating rotor 144 may be secured even by considering that a temperature of the end portion of the axial direction easily increases and decreases. In detail, as the distances b decrease at a rate of 5% or less towards the end portion of the axial direction from the central portion of the axial direction, the temperature uniformity of the heating rotor 144 may be effectively secured.

As in the second embodiment, for example, the forward magnetic circuit units 146*a* and the backward magnetic circuit units 146*b* have the same shape, but may also not have the same shape. If lengths (core widths) of respective magnetic circuit units in an axial direction are constant, the magnetic circuit units may have different shapes.

Also, the length of the heating rotor 144 in the axial direction, the external diameter thereof, the distance between the excitation coils 145 and the heating rotor 144, the distance between the excitation coils 145 and the magnetic core 146, and the like are not limited to the above embodiments and may have appropriate values according to a size of paper, functions required to operate the fixing apparatus, etc.

In addition, in the above embodiments, the distances b between the neighboring forward magnetic circuit units 146*a* and between the neighboring backward magnetic circuit units 146*b* decrease from the central portion of the axial direction towards the end portion thereof. However, the distances b may be equal or may increase from the central portion of the axial direction towards the end portion thereof. Moreover, the rate at which the distances b decreases from the central portion of the axial direction towards the end portion thereof is not limited to 5%. The rate may be changed to secure the temperature uniformity in the axial direction.

Furthermore, the image forming apparatus 101 according to the second embodiment may have or may not have the same features as those described in the first embodiment.

In a fixing apparatus using an electromagnetic induction heating (IH), a temperature of a heating rotor is uniformly maintained, and heat is prevented from being unnecessarily emitted, thereby improving energy efficiency. A method of securing temperature uniformity of a heating rotor is required without enlargement of the fixing apparatus or an increase in costs.

The fixing apparatus includes a rotor including a heating layer, a magnetic flux generator arranged outside the rotor and generating a magnetic flux, and a magnetic circuit formation unit covering the magnetic flux generator and forming a magnetic circuit for the magnetic flux. The magnetic flux generator includes first and second magnetic flux generators that extend in parallel in an axial direction of the rotor, and the magnetic circuit formation unit includes first magnetic circuit units covering the first magnetic flux generator and second magnetic circuit units covering the second magnetic flux generator. The first and second magnetic circuit units are alternately arranged in the axial direction. When lengths of the first and second magnetic flux generators in the axial direction are d, lengths of the first and second magnetic circuit units are a, and distances between neighboring first magnetic circuit units and between neighboring second magnetic circuit units are b, the following conditions $$b/d \leq 0.2$$

$$0.5 \leq b/a \leq 2$$

are satisfied.

Also, the first magnetic circuit units and the second magnetic circuit units may have the same shape.

Also, the distance between the first magnetic circuit units may decrease and the distance between the second magnetic circuit units may decrease from the central portion of the axial direction towards the end portion thereof.

Also, the distance between the first magnetic circuit units may decrease and the distance between the second magnetic circuit units may decrease at a rate of 5% or less from the central portion of the axial direction towards the end portion thereof.

As described above, one or more embodiments of the fixing apparatus and the image forming apparatus are not limited to the above embodiments and may be adjusted within the scope of the claims.

The invention claimed is:

1. A fixing apparatus comprising:

a magnetic field generator configured to generate a magnetic field;

a rotor heated due to the magnetic field; and first and second thermally sensitive magnetic alloys arranged inside the rotor, wherein a first Curie point that is a Curie point of the first thermally sensitive magnetic alloy is higher than a second Curie point that is a Curie point of the second thermally sensitive magnetic alloy.

2. The fixing apparatus of claim 1, wherein the magnetic field generator is located outside the rotor, and the first and second thermally sensitive magnetic alloys are sequentially located on a side opposite to the magnetic field generator with respect to the rotor in a radial direction of the rotor.

3. The fixing apparatus of claim 2, wherein the rotor, the first thermally sensitive magnetic alloy, and the second thermally sensitive magnetic alloy sequentially overlap and contact each other.

4. The fixing apparatus of claim 3, wherein the second Curie point is lower than a temperature of the rotor during a period when a general printing process is performed.

5. The fixing apparatus of claim 3, wherein a thickness of the second thermally sensitive magnetic alloy is greater than a thickness of the first thermally sensitive magnetic alloy.

6. The fixing apparatus of claim 1, wherein the magnetic field generator comprises a magnetic flux generator configured to generate a magnetic flux and a magnetic circuit formation unit configured to cover the magnetic flux generator and form a magnetic circuit for the magnetic flux, the magnetic flux generator comprises a first magnetic flux generator and a second magnetic flux generator extending in parallel in an axial direction of the rotor, the magnetic circuit formation unit comprises a plurality of first magnetic circuit units configured to cover the first magnetic flux generator and a plurality of second magnetic circuit units configured to cover the second magnetic flux generator, the plurality of first magnetic circuit units and the plurality of second magnetic circuit units are alternately arranged in the axial direction, and when a length of the first magnetic flux generator and the second magnetic flux generator in the axial direction is d, a length of the plurality of first magnetic circuit units and the plurality of second magnetic circuit units in the axial direction is a, a distance between neighboring first magnetic circuit units and a distance between neighboring second magnetic circuit units are b, following conditions $$b/d \leq 0.2$$

$$0.5 \leq b/a \leq 2$$

are satisfied.

7. The fixing apparatus of claim 6, wherein the plurality of first magnetic circuit units and the plurality of second magnetic circuit units have a same shape.

8. The fixing apparatus of claim 6, wherein the distance between the neighboring first magnetic circuit units decreases towards an end portion of the axial direction from a central portion of the axial direction, and the distance between the neighboring second magnetic circuit units decreases towards the end portion of the axial direction from the central portion of the axial direction.

9. The fixing apparatus of claim 8, wherein the distance between the neighboring first magnetic circuit units decreases at a rate of 5% or less towards the end portion of the axial direction from the central portion of the axial direction, and the distance between the neighboring second magnetic circuit units decreases at a rate of 5% or less towards the end portion of the axial direction from the central portion of the axial direction.

10. The fixing apparatus of claim 6, wherein the plurality of first magnetic circuit units cover a part or an entire circumferential direction of the first magnetic flux generator, and the plurality of second magnetic circuit units cover a second part or a second entire circumferential direction of the second magnetic flux generator.

11. The fixing apparatus of claim 6, wherein the plurality of first magnetic circuit units and the plurality of second magnetic circuit units do not cover a middle of a gap between the first magnetic flux generator and the second magnetic flux generator.

12. An image forming apparatus comprising the fixing apparatus of claim 1.

13. The fixing apparatus of claim 1, wherein the first Curie point is higher than a temperature of the rotor during a period when a general printing process is performed, and the second Curie point is lower than the temperature of the rotor during the period when the general printing process is performed.

14. A fixing apparatus comprising:

a rotor heated due to a magnetic flux;

a magnetic flux generator arranged outside the rotor and configured to generate the magnetic flux; and a magnetic circuit formation unit configured to cover the magnetic flux generator and form a magnetic circuit for the magnetic flux, wherein the magnetic flux generator comprises a first magnetic flux generator and a second magnetic flux generator that are arranged in parallel and extend in an axial direction of the rotor, the magnetic circuit formation unit comprises a plurality of first magnetic circuit units configured to cover the first magnetic flux generator and a plurality of second magnetic circuit units configured to cover the second magnetic flux generator, the plurality of first magnetic circuit units and the plurality of second magnetic circuit units are alternately arranged in the axial direction, when a length of the first magnetic flux generator and the second magnetic flux generator in the axial direction is d, a length of the plurality of first magnetic circuit units and the plurality of second magnetic circuit units in the axial direction is a, and distances between neighboring first magnetic circuit units and between neighboring second magnetic circuit units are b, following conditions $$b/d \leq 0.2$$

$$0.5 \leq b/a \leq 2$$

are satisfied.

15. The fixing apparatus of claim 14, wherein the plurality of first magnetic circuit units and the plurality of second magnetic circuit units have a same shape.

16. The fixing apparatus of claim 14, wherein the distance between the neighboring first magnetic circuit units decreases towards an end portion of the axial direction from a central portion of the axial direction, and the distance between the neighboring second magnetic circuit units decreases towards the end portion of the axial direction from the central portion of the axial direction.

17. The fixing apparatus of claim 16, wherein the distance between the neighboring first magnetic circuit units decreases at a rate of 5% or less towards the end portion of the axial direction from the central portion of the axial direction, and the distance between the neighboring second magnetic circuit units decreases at a rate of 5% or less towards the end portion of the axial direction from the central portion of the axial direction.

18. The fixing apparatus of claim 14, wherein the plurality of first magnetic circuit units cover a part or an entire circumferential direction of the first magnetic flux generator, and the plurality of second magnetic circuit units cover a second part or a second entire circumferential direction of the second magnetic flux generator.

19. The fixing apparatus of claim 14, wherein the plurality of first magnetic circuit units and the plurality of second magnetic circuit units do not cover a middle of a gap between the first magnetic flux generator and the second magnetic flux generator.

* * * * *